US009098068B2

(12) United States Patent
Greubel et al.

(10) Patent No.: US 9,098,068 B2
(45) Date of Patent: Aug. 4, 2015

(54) TIMEPIECE COMPRISING A STRIKING MECHANISM

(75) Inventors: Robert Greubel, Lignieres (CH); Stephen Forsey, Les Brenets (CH); Amel Kapetanovic, La Chaux-de-Fonds (CH)

(73) Assignee: COMPLITIME SA, La Chaux-De-Fonds (CH)

( * ) Notice: Subject to any disclaimer, the term of this patent is extended or adjusted under 35 U.S.C. 154(b) by 117 days.

(21) Appl. No.: 13/808,970

(22) PCT Filed: Jul. 4, 2011

(86) PCT No.: PCT/EP2011/061237

§ 371 (c)(1),
(2), (4) Date: Jan. 8, 2013

(87) PCT Pub. No.: WO2012/004224

PCT Pub. Date: Jan. 12, 2012

(65) Prior Publication Data

US 2013/0121120 A1 May 16, 2013

(30) Foreign Application Priority Data

Jul. 8, 2010 (CH) ..... 11151/10

(51) Int. Cl.
*G04B 21/06* (2006.01)
*G04B 21/02* (2006.01)
(Continued)

(52) U.S. Cl.
CPC ..... *G04B 21/06* (2013.01); *G04B 11/006* (2013.01); *G04B 21/02* (2013.01); *G04B 21/12* (2013.01)

(58) Field of Classification Search
CPC ..... G04B 21/12; G04B 23/12; G04B 21/04; G04B 21/06; G04B 21/00; G04B 21/02; G04B 11/006
USPC ..... 368/75, 100, 243, 267, 269, 315
See application file for complete search history.

(56) References Cited

U.S. PATENT DOCUMENTS 7,320,543 B2 * 1/2008 Goeller ..... 368/100
7,330,403 B2 * 2/2008 Goeller ..... 368/75
(Continued)

FOREIGN PATENT DOCUMENTS

CH 9700 A 7/1895
CH 13895 † 2/1897
(Continued)

OTHER PUBLICATIONS

International Search Report, dated Dec. 2, 2011, from corresponding PCT application.

*Primary Examiner* — Amy Cohen Johnson
*Assistant Examiner* — Matthew Powell
(74) *Attorney, Agent, or Firm* — Young & Thompson

(57) ABSTRACT

A timepiece includes a chime mechanism (1) having an hours component (2), a quarters component (4) and a minutes component (6), the hours (2), quarters (4) and minutes (6) components being pivot-mounted about one and the same spindle (3), the quarters component (4) and the minutes component (6) being kinematically linked by a first driving member collaborating with a first driving toothset (34). Out of the hours component (2) and the quarters component (4), one includes a second driving toothset (21) and the other includes a second driving member designed to be capable of collaborating with the second driving toothset (21) and of kinematically linking the hours component (2) and the quarters component (4), thereby eliminating the dead time between the chimes for the hours and those for the quarters, or between those for the hours and those for the minutes when there isn't a quarter to chime.

15 Claims, 11 Drawing Sheets

(51) Int. Cl.
*G04B 11/00* (2006.01)
*G04B 21/12* (2006.01)

(56) References Cited

U.S. PATENT DOCUMENTS

2008/0192585 A1* 8/2008 Corthesy et al. ..... 368/268
2008/0273426 A1* 11/2008 Corthesy et al. ..... 368/262
2010/0002546 A1* 1/2010 Rochat et al. ..... 368/72
2010/0214884 A1* 8/2010 Corthesy et al. ..... 368/266
2011/0032803 A1* 2/2011 Journe ..... 368/72
2011/0116348 A1* 5/2011 Papi ..... 368/270
2012/0230163 A1* 9/2012 Goeller et al. ..... 368/267
2012/0230164 A1* 9/2012 Goeller ..... 368/267

FOREIGN PATENT DOCUMENTS

EP 1760553 A1 † 3/2007
EP 2107438 A1 † 10/2009

* cited by examiner
† cited by third party

TIMEPIECE COMPRISING A STRIKING MECHANISM

TECHNICAL FIELD

The present invention relates to the field of horology. It more particularly relates to a timepiece, in particular a timepiece having a striking mechanism comprising a strike-train, at least two strike-hammers arranged to produce sounds of different timbres, an hour lift and a first quarter lift to actuate one of the hammers, a minute lift and a second quarter lift to actuate the other hammer, an hours component comprising a toothed sector arranged to cooperate with said strike-train, an hour-rack arranged to actuate the hour lift and an hour feeler-spindle arranged to cooperate with an hour cam, a quarters component comprising a quarter-rack having a first toothing arranged to actuate the first quarter lift and a second toothing arranged to actuate the second quarter lift, and a quarter feeler-spindle arranged to cooperate with a quarter cam, and a minutes component comprising a minute-rack arranged to actuate the minute lift and a minute feeler-spindle arranged to cooperate with a minute cam, said hours, quarters and minutes components being pivotably mounted around a same staff, the quarters component and the minutes component being kinematically connected using a first driving organ cooperating with a first driving toothing.

BACKGROUND OF THE INVENTION

Such timepieces have been known for some time, in particular in the field of so-called complicated watches, such as repeaters or watches with a grand-strike mechanism. These watches have more or less complex striking mechanisms with the aim of striking on demand or automatically at regular time intervals.

Such a timepiece is for example described in application EP 1760553. In that document, the timepiece comprises an hours component, a quarters component, and a minutes component respectively comprising a rack and a feeler-spindle secured to one another. Said components are pivotably mounted around a same staff. The driving of the quarters component by the hours component is done using a pin provided on the hours component, engaged with an opening provided on the quarters component.

During operation of the striking-mechanism, the respective initial positions of the pin and the opening vary as a function of the position of the hours component and the quarters component, respectively, depending on the current time. As a result, the time necessary for the pin of the hours component to come into contact with the opening of the quarters component varies. That is why there may be a dead time of variable length between the striking of the hours and that of the quarters, or between that of the hours and that of the minutes when there is no quarter to strike.

Another traditional type of striking-mechanism, comprising an hour-ratchet, is described in patent CH 9700. An additional piece called a "vertical rack" is provided placed between the quarters component and the minutes component, and having an inner toothing meshing with the toothed sector of the staff of the fusee. This piece makes it possible to regularize the interval between the striking of the hours and minutes, the toothed sector of the staff of the fusee meshing by its first tooth with the appropriate tooth of the toothing of said vertical rack. However, such a mechanism requires an additional part in a mechanism that is already complex. Furthermore, this construction leads to a break in meshing, which could cause critical situations to arise, such as butting causing a loss of efficiency.

Furthermore, the strike driving mechanisms are generally complex and provide for a superposition of various elements making it possible to prepare for striking, then allowing striking in cooperation with the strike-train.

One aim of the present invention is therefore to offset these drawbacks by proposing a timepiece with a strike-mechanism making it possible to eliminate the dead time between the striking of the hours and that of the quarters, or between that of the hours and that of the minutes when there is no quarter to strike.

Another aim is to propose a timepiece making it possible to use a simplified strike driving mechanism.

BRIEF DESCRIPTION OF THE INVENTION

To that end, and according to the present invention, a timepiece is proposed having a striking mechanism comprising a strike-train, at least two strike-hammers arranged to produce sounds of different timbres, an hour lift and a first quarter lift to actuate one of the hammers, a minute lift and a second quarter lift to actuate the other hammer, an hours component comprising a toothed sector arranged to cooperate with the strike-train, an hour-rack arranged to actuate the hour lift and an hour feeler-spindle arranged to cooperate with an hour cam, a quarters component comprising a quarter-rack having a first toothing arranged to actuate the first quarter lift and a second toothing arranged to actuate the second quarter lift, and a quarter feeler-spindle arranged to cooperate with a quarter cam, and a minutes component comprising a minute-rack arranged to actuate the minute lift and a minute feeler-spindle arranged to cooperate with a minute cam, said hours, quarters and minutes components being pivotably mounted around a same staff, the quarters component and the minutes component being kinematically connected using a first driving organ cooperating with a first driving toothing. According to the invention, one of the hours and quarters components comprises a second driving toothing and the other of the hours and quarters components comprises a second driving organ arranged to be able to cooperate directly with said second driving toothing and kinematically connect the hours component and the quarters component, while eliminating the dead time between the striking of the hours and that of the quarters, or between that of the hours and that of the minutes when there is no quarter to strike.

Advantageously, the first driving organ may comprise a first hook pivotably mounted on the quarters component, the first driving toothing being provided on the minutes component across from said first hook. Preferably, a first banking is provided mounted stationary on the frame of the timepiece, the first hook being arranged to cooperate with said first banking so as to pivot to cooperate with one of the teeth of said first driving toothing as a function of the position of the minutes component.

Advantageously, a second banking is provided mounted stationary on the frame of said timepiece, the second driving organ being arranged to cooperate with said second banking so as to be able to cooperate with one of the teeth of said second driving toothing as a function of the position of said second driving toothing and eliminate the dead times. Preferably, the second driving organ may comprise a second hook. Advantageously, said second hook is pivotably mounted on the hours component and the second driving toothing is provided on the quarters component across from said second hook.

Advantageously, the strike-train comprises a strike driving wheel that may comprise, arranged coaxially, a strike-wheel cooperating with an energy source, a first pinion cooperating with the hours component, and a coupling system arranged to move between a coupled position, in which said strike-wheel is kinematically connected to said first pinion to allow striking, and a disconnected position, in which said first pinion is disconnected from said strike-wheel to allow preparation for striking.

Preferably, the coupling system comprises a click secured to the strike-wheel and having a beak and a second pinion secured to the first pinion and arranged to be able to cooperate with the beak of the click, said click being arranged to move between the coupled position, in which the beak cooperates with said second pinion, said first and second pinions being rotated by the strike-wheel, and the disconnected position, in which the beak of the click is freed from said second pinion, said first and second pinions then being freely rotating relative to the strike-wheel.

According to a first embodiment, the coupling system may comprise a first plate secured to the strike-wheel, the click being supported by said first plate, said click comprising a first end pivotably mounted on said first plate and a second free end having the beak.

Preferably, the click may bear a pin cooperating with a detent ratchet mounted freely rotating coaxially to the strike-wheel and controlled by a control organ, part of the click between the pin and the beak being arranged eccentrically relative to the axis of the strike driving wheel.

Advantageously, to reach the disconnected position, said detent ratchet is arranged to be driven by said control organ, and to move the second end of the click by driving the pin such that the beak of the click is freed from the second pinion. To reach the coupled position, said detent ratchet is arranged to be blocked by said control organ, so as to retain the pin, and the strike-wheel is arranged to be rotated and to take the first plate and the first end of the click such that said click tips while returning its beak into cooperation with the second pinion.

According to another embodiment, the coupling system may comprise a second plate comprising a first toothed sector and pivotably mounted on the strike-wheel, the click being secured to said second plate. The coupling system may also comprise a central tube having a second toothed sector arranged to cooperate with the first toothed sector of the second plate and secured to a control ratchet controlled by a control organ. Advantageously, to reach the disconnected position, said control ratchet is arranged to be driven by said control organ, and to move the click by driving the first toothed sector of the second plate such that the beak of the click is freed from the second pinion. To reach the coupled position, said control ratchet is arranged to be blocked by said control organ, so as to retain the first toothed sector of the second plate and the strike-wheel is arranged to be rotated and to take the second plate and the click such that said click tips while returning its beak into cooperation with the second pinion.

BRIEF DESCRIPTION OF THE DRAWINGS

Other features of the present invention will appear more clearly upon reading the following description, done in reference to the appended drawings, in which.

DETAILED DESCRIPTION OF THE INVENTION

Figure 1:
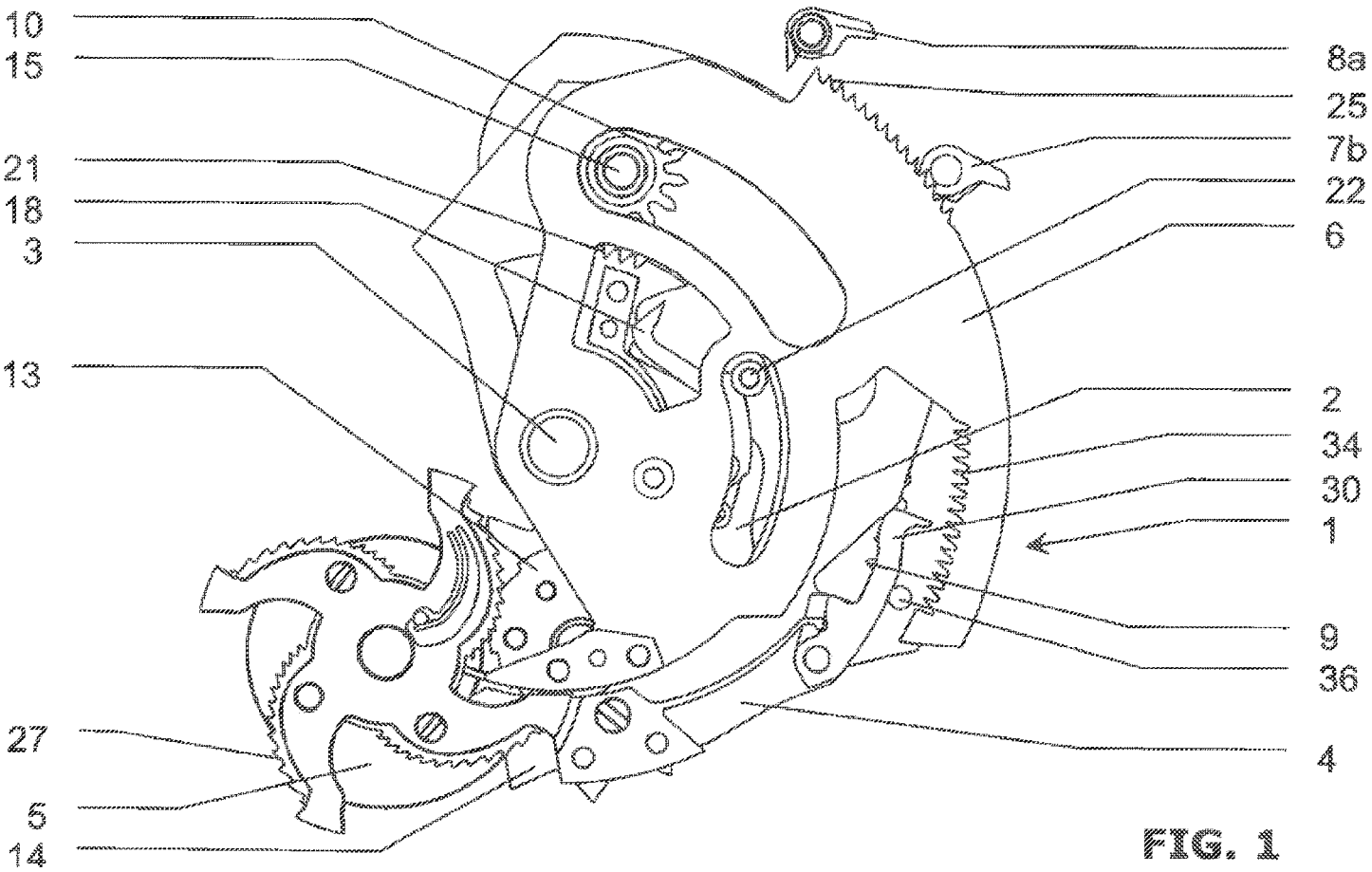
FIG. 1 is a side view, on the bar side, of three hours, quarters, and minutes components according to the invention, ready to strike.

The figures show only the parts of the strike-mechanism that are essential to understand the invention. For clarification purposes, the common elements known by those skilled in the art have not been shown in the drawings.

In reference to FIG. 1, a strike-mechanism 1 used in a timepiece according to the invention is shown.

The mechanism comprises an hours component 2, a quarters component 4, and a minutes component 6, which are, in a known manner, designed to cooperate with an hour lift 7*a* and a first quarter lift 7*b*, mounted on the same staff, to actuate a first hammer, and with a minute lift 8*a* and a second quarter lift 8*b*, mounted on the same staff, to actuate a second hammer arranged to produce sounds of a different timbre from the first hammer.

Figure 2:
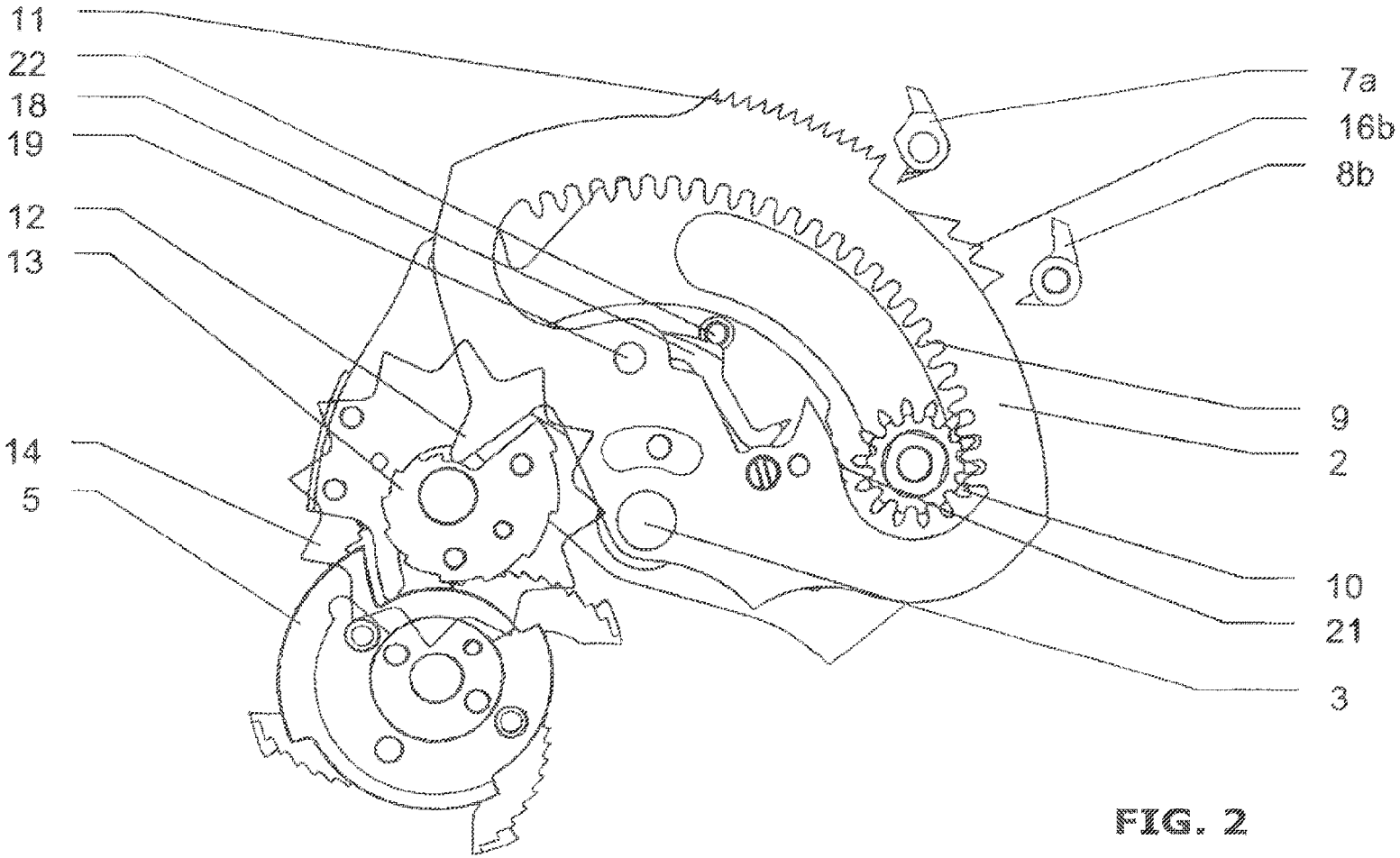
FIG. 2 is a view, on the dial side, of the hours and quarters components according to the invention, ready to strike.
Figure 3:
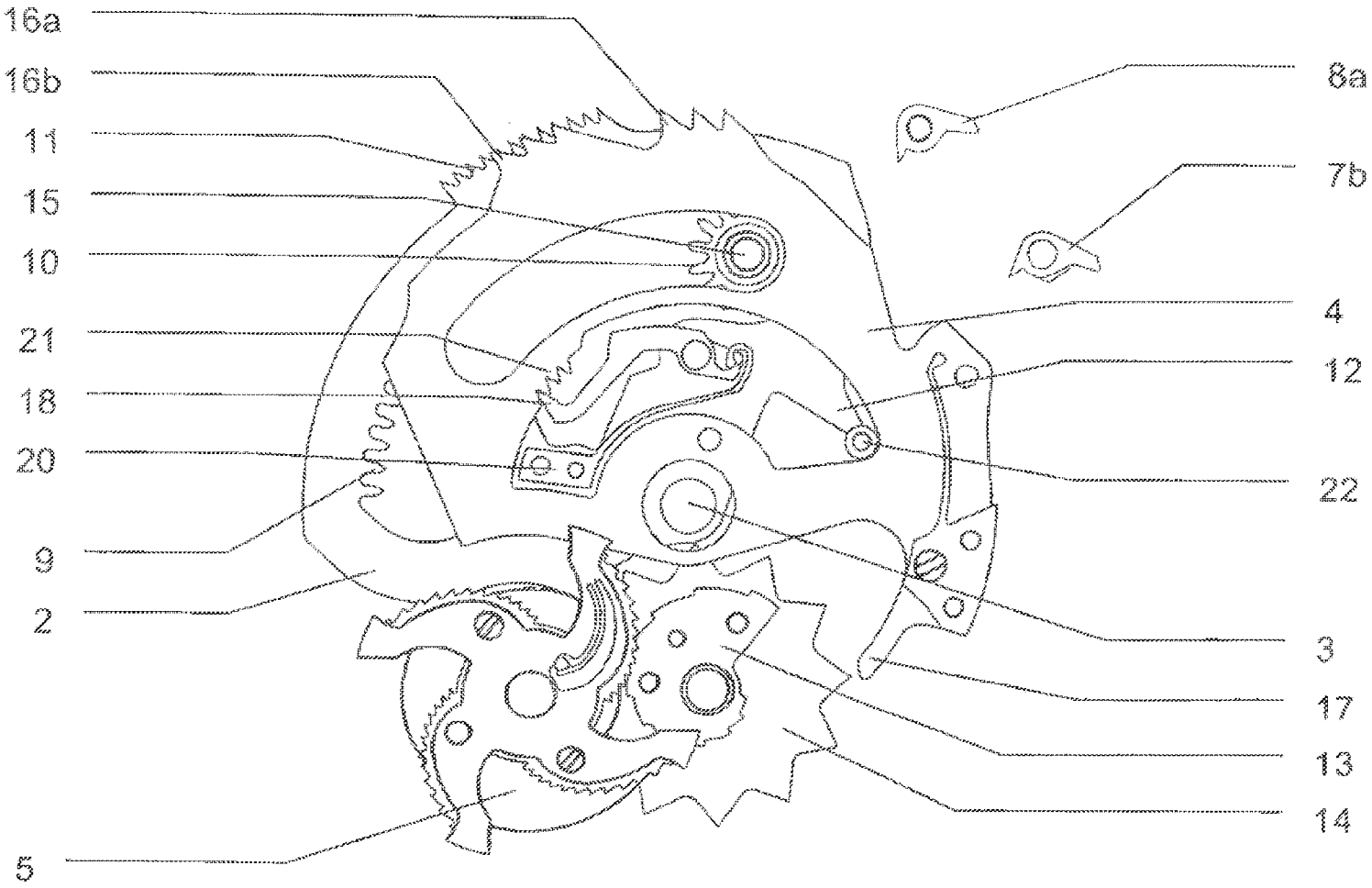
FIG. 3 is a side view, on the bar side, of the hours and quarters components according to the invention, in their position before and after striking.

In reference more particularly to FIGS. 1 to 3, the hours component 2 is in the general shape of an arc of circle and is pivotably mounted around a staff 3 passing through the center of that circle. It includes an open inner space having, along one rim thereof, a circular toothed sector 9, concentric to the hours component 2, and arranged to cooperate with the pinion 10 of the strike driving wheel, as will be described hereafter. The hours component 2 also comprises, on the outer rim thereof, an hour-rack 11 arranged to actuate the hour lift 7*a* and, on the opposite side, an hour feeler-spindle 12 arranged to cooperate with an hour cam 13, supported by a starwheel 14, and traditionally driven by a basic movement (not shown), so as to acquire information relative to the current time. The hour feeler-spindle 12 may be made in a single piece with the hours component 2 or may be an attached element securely mounted to said hours component 2. These elements are known by those skilled in the art and do not require a detailed description.

The quarters component 4 is in the general shape of an arc of circle, concentric to the arc of circle of the hours component 2, and is pivotably mounted around the staff 3. It has a first circular open inner space, concentric, allowing the passage of the staff 15 of the strike driving wheel. In a known manner, the quarters component 4 comprises, on the outer rim thereof, a quarter-rack having a first toothing 16*a*, with three teeth, arranged to actuate the first quarter lift 7*b*, and a second toothing 16*b*, with three teeth, arranged to actuate the second quarter lift 8*b*, so as to strike the quarters on two timbres. On the side opposite the rack, the quarters component 4 comprises a quarter feeler-spindle 17 arranged to cooperate with a quarter cam 5, traditionally driven by a basic movement (not shown), so as to acquire information relative to the current time. The quarter feeler-spindle 17 may be made in a single piece with the quarters component 4 or may be an attached element securely mounted to said quarters component 4. A spring (not shown) is arranged so as to exert a force on the quarters component 4 tending to bring the quarter feeler-spindle 17 into contact with the quarter cam 5. These elements are known by those skilled in the art and do not require a detailed description.

According to the invention, the hours component 2 and the quarters component 4 are kinematically connected using a drive organ cooperating with a drive toothing, said drive organ and said drive toothing being arranged to eliminate the dead times between the striking of the hours and that of the quarters, or between that of the hours and that of the minutes when there is no quarter to strike.

More specifically, the hours component 2 comprises, on the rim of its open inner space, opposite the rim supporting the toothed sector, a hook 18 pivotably mounted around a staff 19 and its return-spring 20. At the hook 18, the hours component 2 comprises a recess forming a housing for said hook 18 allowing it to pivot.

The quarters component 4 comprises, approaching its center, a second circular open inner space, concentric, arranged relative to the hours component 2 such that the hook 18 of the hours component appears in said second open inner space of the quarters component 4. Furthermore, said second open inner space of the quarters component 4 has, along the rim thereof, across from the hook 18, a drive toothing 21, with three teeth sized so that the four flanks present correspond to the number of quarters to be struck (flank 1=0 quarters to be struck, flank 2=1 quarter to be struck, flank 3=2 quarters to be struck, flank 4=3 quarters to be struck).

Furthermore, a second banking 22 is provided mounted stationary on the frame of said component, the second hook 18 being arranged to cooperate with said second banking 22 so as to pivot to cooperate with one of the teeth of the second drive toothing 21 as a function of the position of the quarters component 4 and eliminate the dead times.

More specifically, a banking 22, such as a pin, is provided mounted stationary on the frame of the timepiece, cooperating with the hook 18, which has a shape such that, when the hours component 2 pivots around its staff 3 and falls while driving the hook 18, the latter encounters the banking 22 and is lifted to be freed from the drive toothing 21, and when the hours component pivots around its staff 3 during striking while driving the hook 18, said hook 18 is no longer retained by the banking 22 and pivots to cooperate with the tooth of the drive toothing 21 of the quarters component 4, as will be described later.

Figure 4:
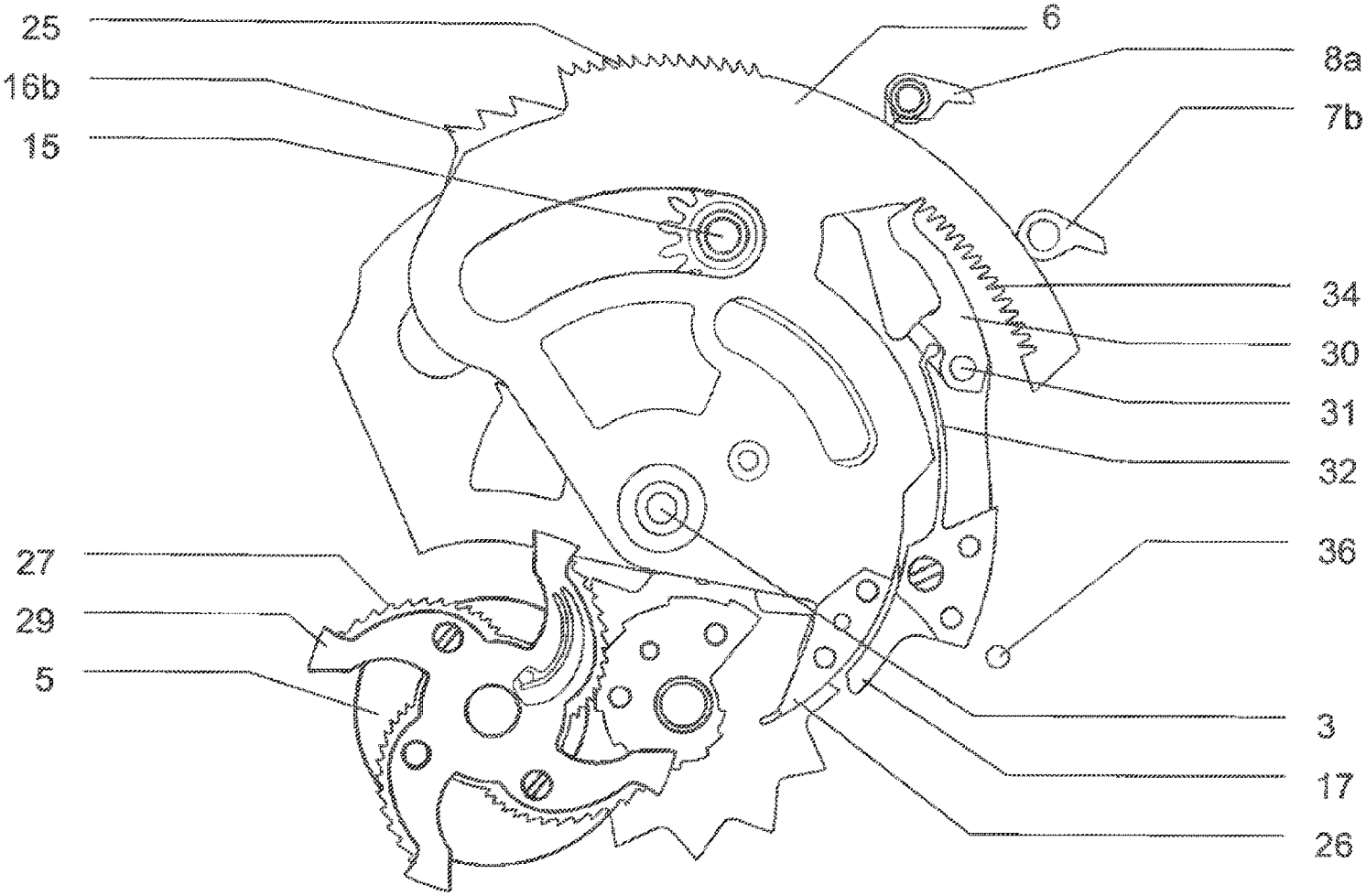
FIG. 4 is a side view, on the bar side, of the quarters and minutes components according to the invention, before and after striking.

In reference to FIG. 4, the minutes component 6 is generally in the shape of an arc of circle, concentric to the arc of circle of the hours component 2 and the quarters component 4, and is pivotably mounted around the staff 3. In this way, the three hours 2, quarters 4 and minutes 6 components are generally concentric and pivot around a same staff 3.

The minutes component 6 has a circular open inner space, concentric, allowing the passage of the staff 15 of the strike driving wheel. In a known manner, it comprises a minute-rack 25 on its outer rim arranged to actuate the minute lift 8*a*, and a minute feeler-spindle 26 on the opposite side arranged to cooperate with a minute cam 27 traditionally driven by the basic movement (not shown), so as to acquire information relative to the current time. In a known manner, the minute cam 27 and the quarter cam 5 are coaxial and comprise a surprise-piece 29. The minute feeler-spindle 26 may be made in a single piece with the minutes component 6 or may be an attached element securely mounted to said minutes component 6. A spring (not shown) is arranged so as to exert a force on the minutes component 6 tending to bring the minute feeler-spindle 26 into contact with the minute cam 27. These elements are known by those skilled in the art and do not require a detailed description.

In a known manner, the quarters component 4 and the minutes component 6 are kinematically connected using a drive organ cooperating with a first toothing.

More specifically, the quarters component 4 also has, on the outer perimeter thereof, in the extension of the quarter feeler-spindle 17, a hook 30, pivotably mounted around a staff 31 and its return-spring 32. These elements are not shown in FIGS. 2 and 3 so as to avoid complicating the drawings. The minutes component 6 comprises, at the hook 30, a concentric circular opening, arranged relative to the quarters component 4 such that the hook 30 of the quarters component appears in said opening of the minutes component 6. Furthermore, said opening of the minutes component 6 has, along its rim, across from the hook 30, a drive toothing 34, with 14 teeth sized so that the 15 flanks correspond to the number of minutes to be struck (flank 1=0 minutes to be struck, flank 2 equals=1 minute to be struck, flank 15=14 minutes to be struck).

Furthermore, a banking 36, such as a pin, is provided, mounted stationary on the frame of the timepiece, cooperating with the hook 30, which has a shape such that, when the quarters component 4 pivots around its staff 3 and falls while driving the hook 30, said hook 30 encounters the banking 36 and is lifted to free the drive toothing 34, and when the quarters component 4 pivots around its arbor 3 during striking while driving the hook 30, said hook 30 is no longer retained by the banking 36, and pivots to cooperate with the tooth of the drive toothing 34 of the minutes component 6, as will be described later.

To make the timepiece according to the invention strike, the hours component 2 must be driven by the pinion 10, which may be kinematically connected to any appropriate strike driving wheel. A first embodiment of such a strike driving wheel is described more particularly in reference to FIGS. 5 to 7. This strike driving wheel 40 comprises, arranged coaxially relative to the staff 15, a strike-wheel 41 secured to the staff 15, the pinion 10 mounted freely rotating around said staff 15, and a coupling system 43 arranged to go between a coupled position, in which the strike-wheel 41 is kinematically connected to the pinion 10 to allow striking, and a disconnected position, in which the pinion 10 is disconnected from the strike-wheel 41 to allow preparation for striking.

The strike-wheel 41 cooperates with the other elements of the strike-train, powered by an energy source such as a strike barrel (not shown). As described above, the pinion 10 cooperates with the toothed sector 9 of the hours component 2.

Figure 5:
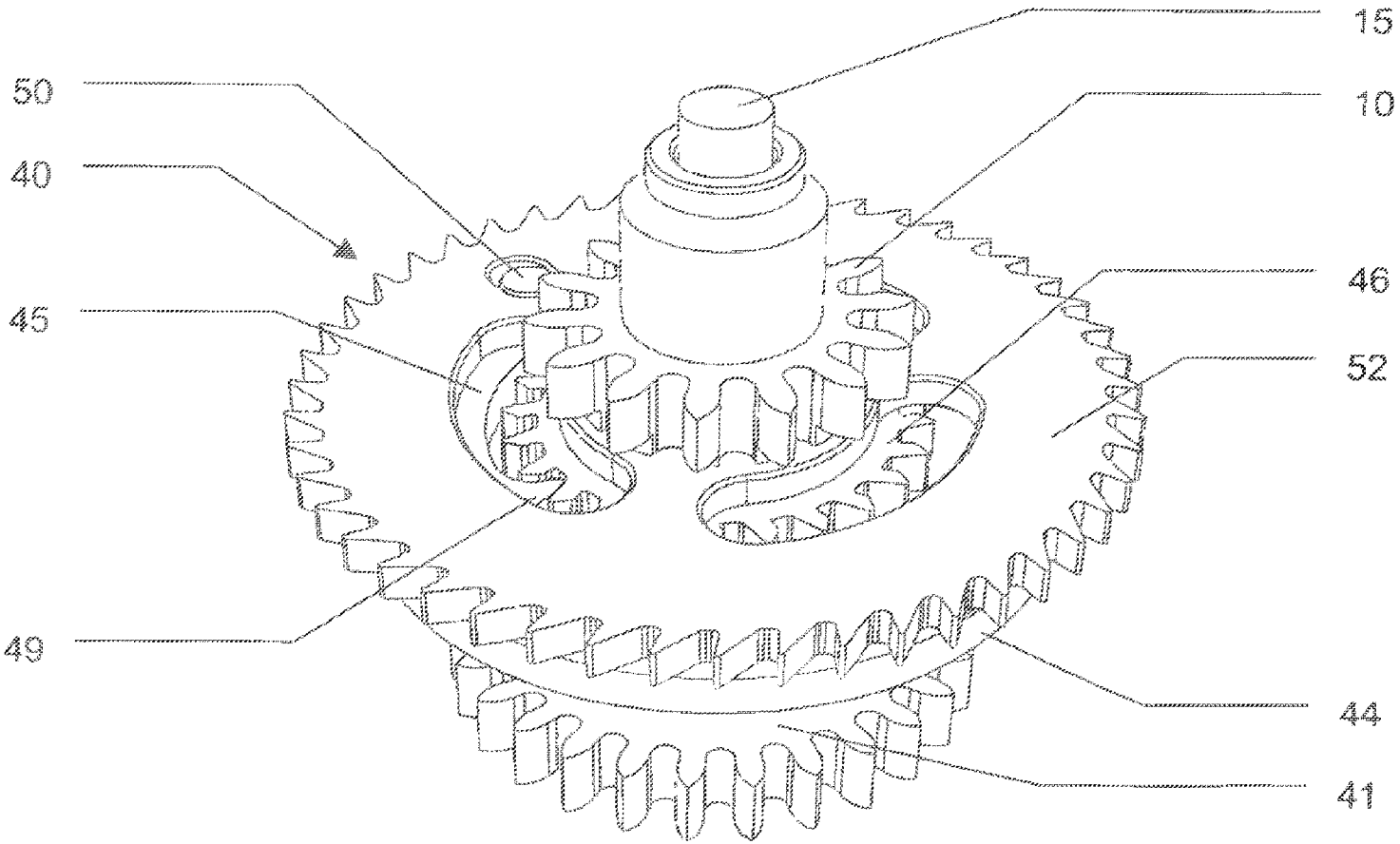
FIG. 5 is a perspective view of a first embodiment of a strike driving wheel according to the invention, the coupling system being in the coupled position.
Figure 6:
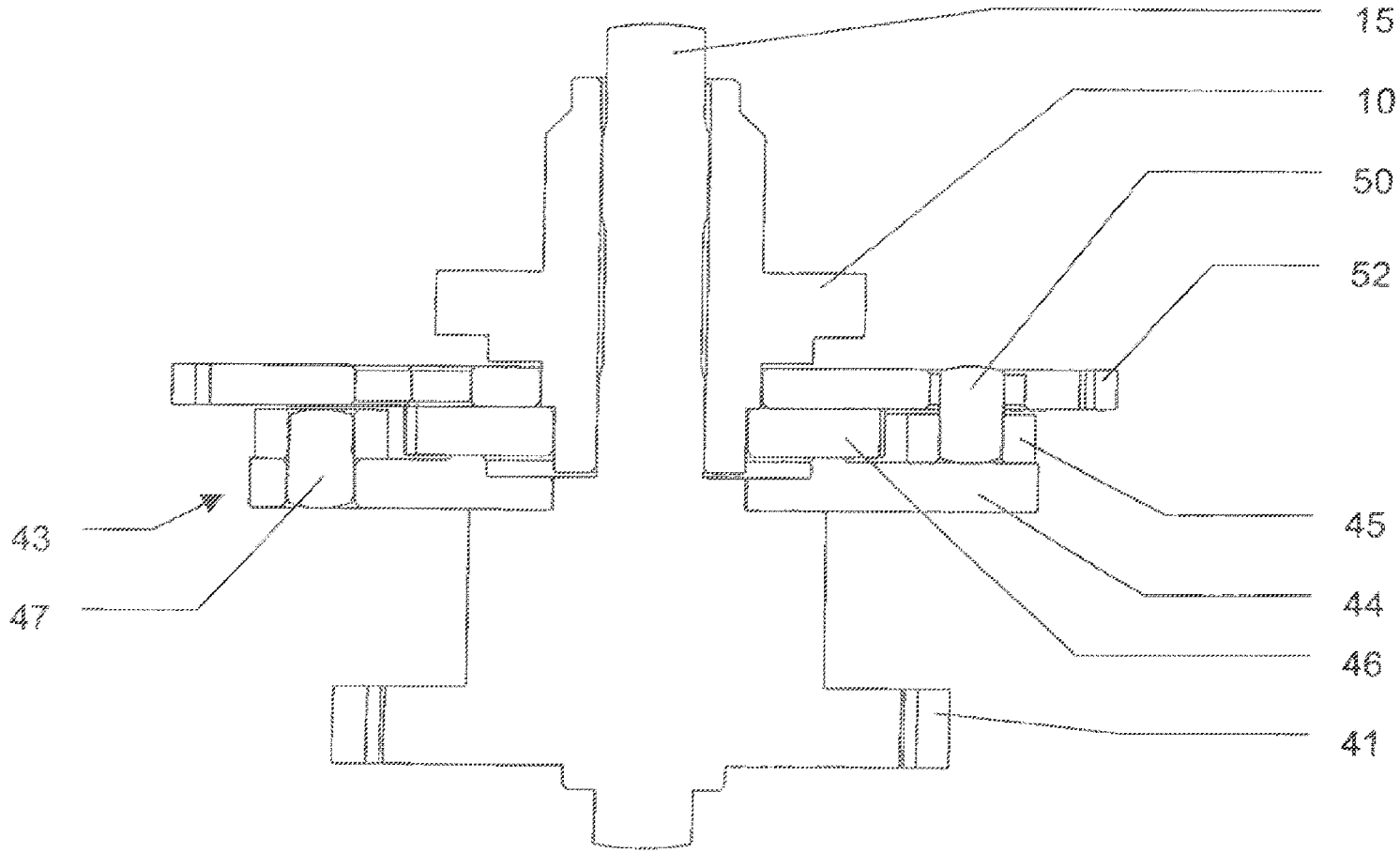
FIG. 6 is a cross-sectional view of FIG. 5.

The coupling system 43 comprises a plate 44 secured to the strike-wheel 41, a click 45 supported by said plate 44 and arranged to go between the coupled position and the disconnected position, and a pinion 46 mounted freely rotating around the staff 15 and secured to the pinion 10. The click 45 comprises a first end 45*a* pivotably mounted on the plate 44 around a staff 47 secured on said plate 44, and a second end 45*b* freely resting on the plate 44 and ending with a beak 49 arranged to cooperate with the pinion 46 in the coupled position as shown in FIG. 5. Furthermore, the click 45 supports a pin 50 mounted passing through a corresponding oblong orifice provided on a ratchet 52. The detent ratchet 52 is mounted freely rotating around the staff 15, above the click 45, and is driven by a control organ, such as a release lever (not shown). The part of the click 45 between the pin 50 and the beak 49 is arranged eccentrically in relation to the staff 15 such that that portion moves away from the staff 15 when the detent ratchet 52 is actuated by the control organ so as to release the beak 49 from the pinion 46, so as to disconnect said pinion 46 from the plate 44 and therefore the strike-wheel 41 in order to reach the disconnected position.

Another alternative embodiment of a strike driving wheel is described more particularly in reference to FIGS. 8 to 11. The parts that are identical to the previous embodiment are shown using the same references.

This strike driving wheel 60 comprises, arranged coaxially to the staff 15, a strike-wheel 61 mounted freely rotating around said staff 15, the pinion 10 secured to the staff 15, and a coupling system 63 arranged to go between a coupled position, in which the strike-wheel 61 is kinematically connected to the pinion 10 to allow striking, and a disconnected position, in which the pinion 10 is disconnected from the strike-wheel 61 to allow preparation for striking.

The strike-wheel 61 cooperates with the other elements of the strike-train, powered by an energy source such as a strike barrel (not shown). As described above, the pinion 10 cooperates with the toothed sector 9 of the hours component 2.

In this alternative, the coupling system 63 comprises a rack 64 coaxial to the staff 15, and having a toothing 65 arranged to cooperate with a control organ such as a release lever (not shown). The rack 64 includes a control click 66 and a spring 67.

The coupling system also comprises a drive ratchet 68 secured to a central tube 69 mounted freely rotating around the staff 15. The drive ratchet 68 comprises a toothing arranged to cooperate with the control click 66 of the rack 64. The central tube 69 comprises a toothed sector 70, the role of which will be described below.

A disconnecting ratchet 72 is also provided secured to the staff 15.

Furthermore, the coupling system 63 comprises a disconnecting click 74 secured to a plate 75 pivotably mounted on a support 76 around a pivot 77 fastened on said support 76. The support 76 is secured to the strike-wheel 61.

The disconnecting click 74 and the support 76 are arranged around the disconnecting ratchet 72, corresponding to the second pinion secured to the first pinion 10. The disconnecting click 74 comprises a beak 78 arranged to cooperate with the toothing of the disconnecting ratchet 72.

The plate 75 includes a central inner opening 80 allowing the passage of the central tube 69 and its toothed sector 70.

Furthermore, provided on the perimeter of the central opening 80 is a toothed sector 82 arranged to cooperate with the toothed sector 70 of the central tube 69.

To improve the compactness of the strike driving wheel 60, the drive ratchet 68 has an opening allowing the passage of the upper portion of the support 76.

Figure 7:
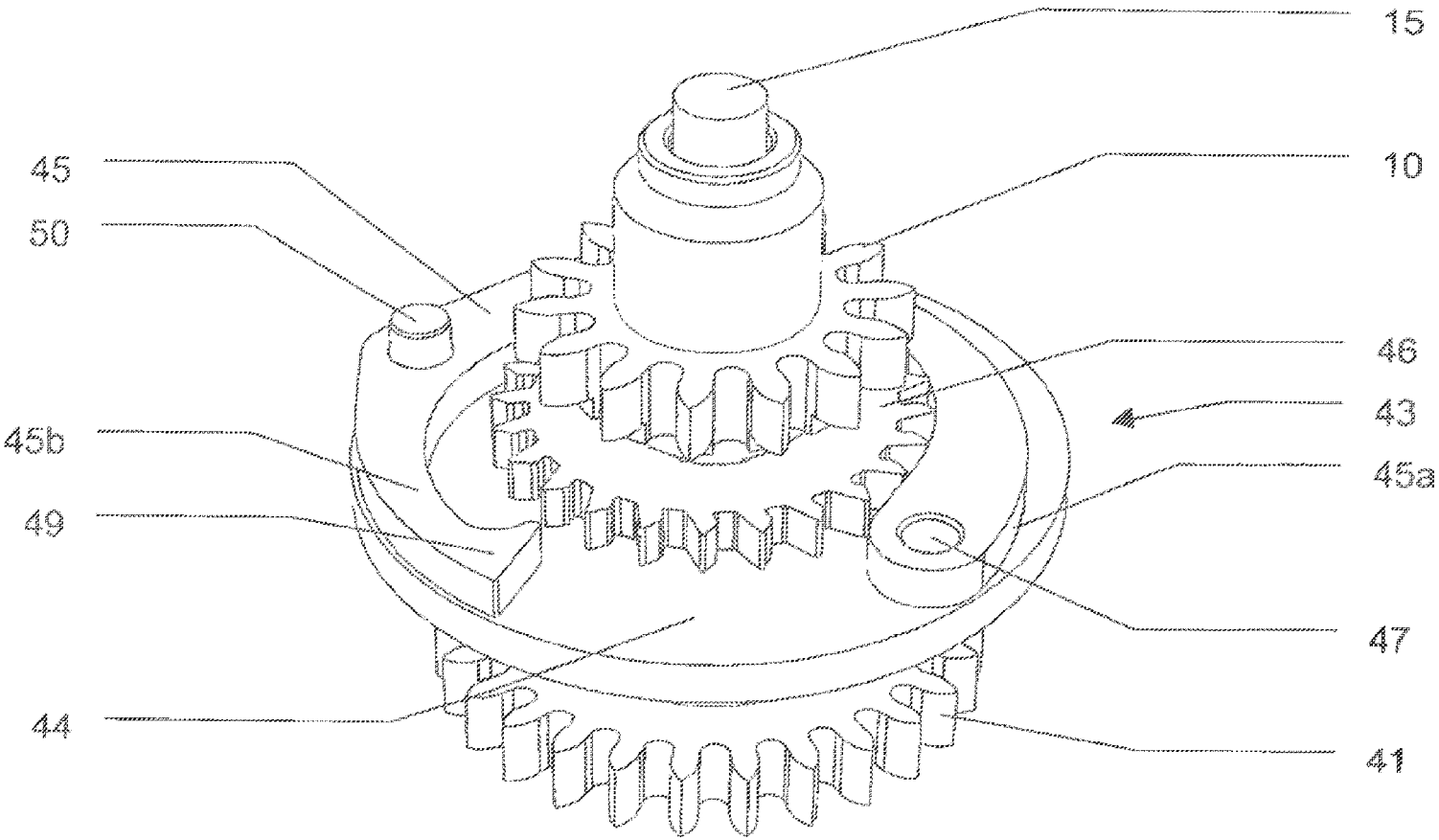
FIG. 7 is a perspective view of part of the strike driving wheel of FIG. 5, the coupling system being in the disconnected position.
Figure 8:
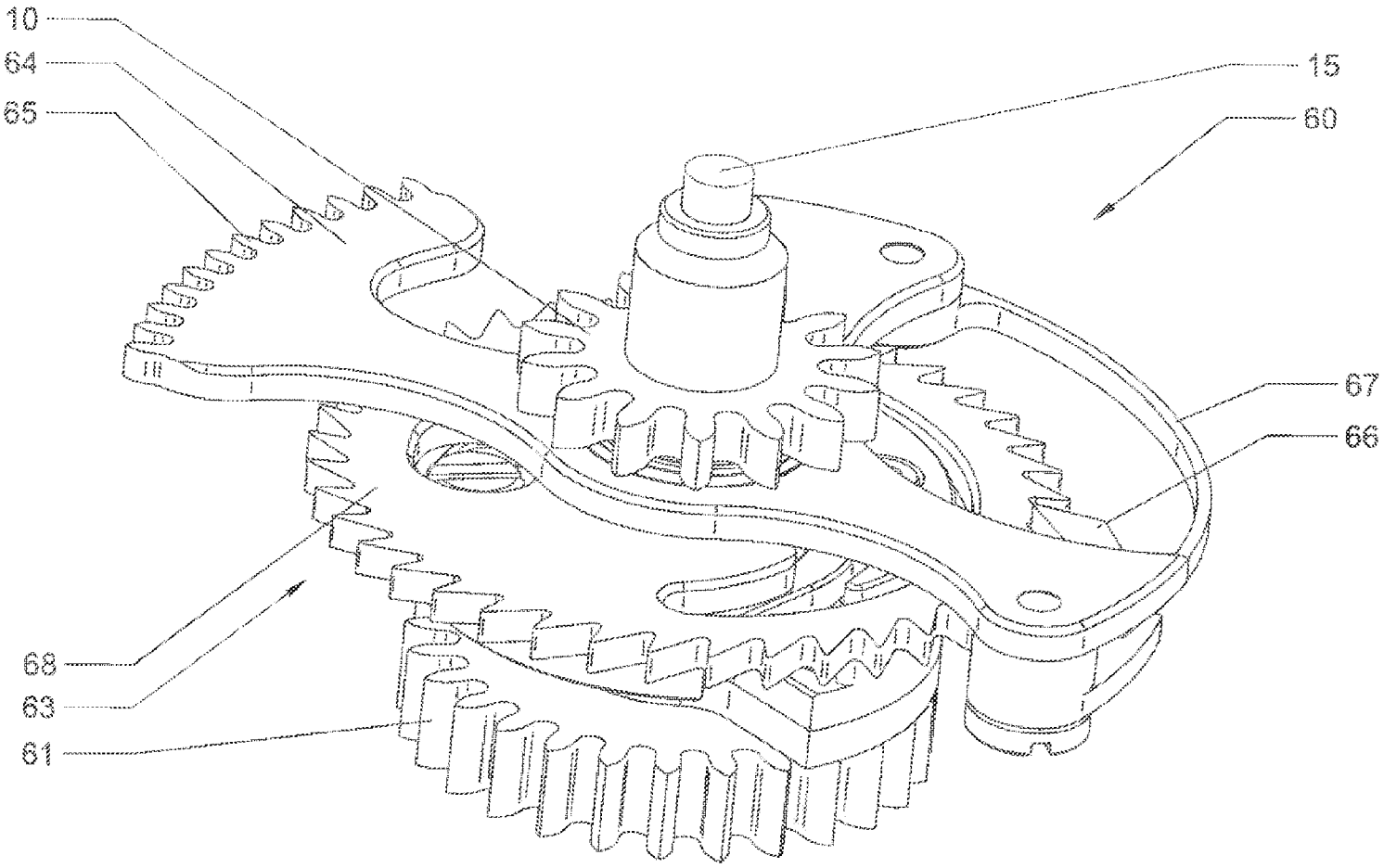
FIGS. 8 to 10 are perspective views of a second embodiment of a strike driving wheel according to the invention.
Figure 9:
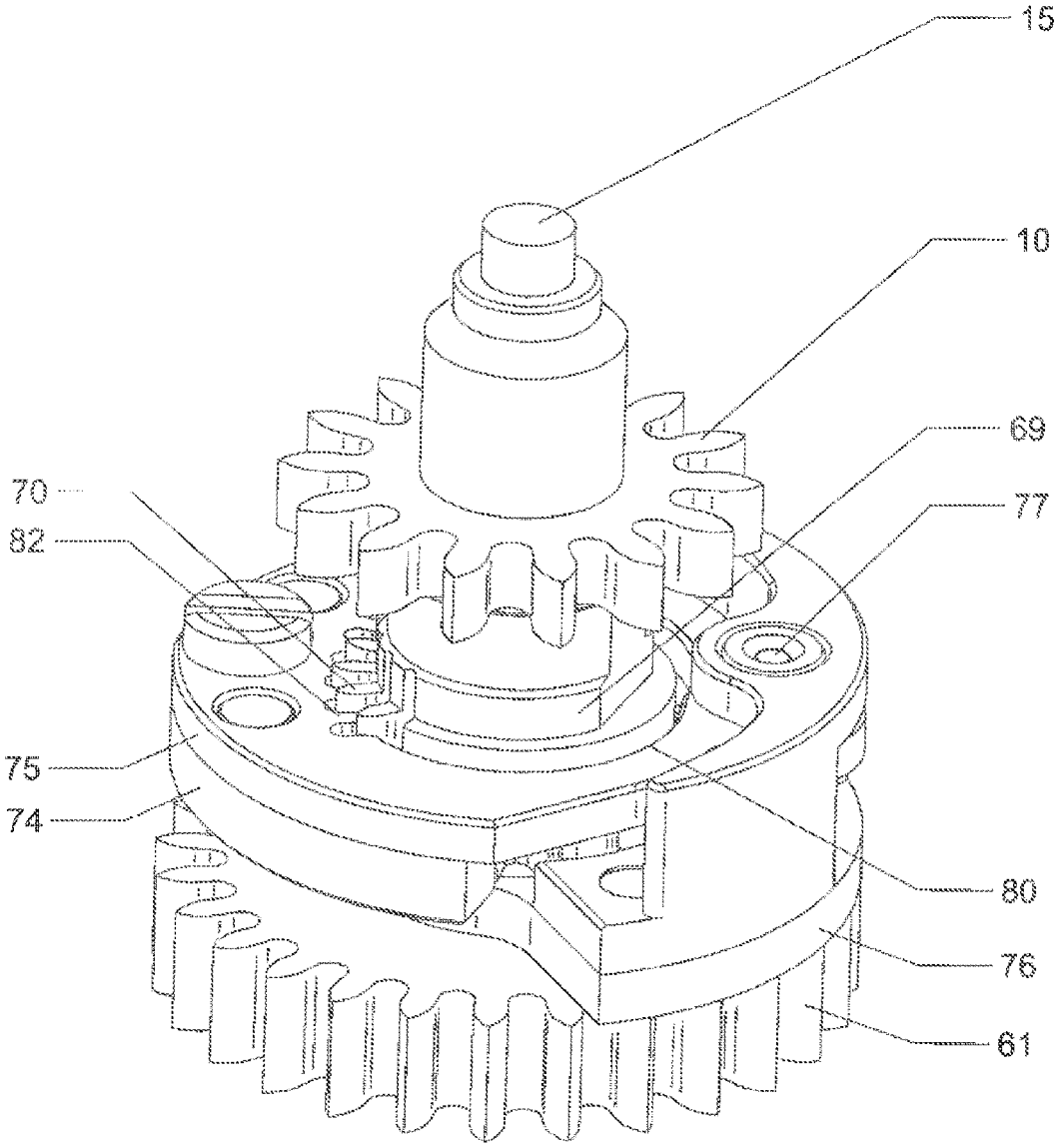
Figure 10:
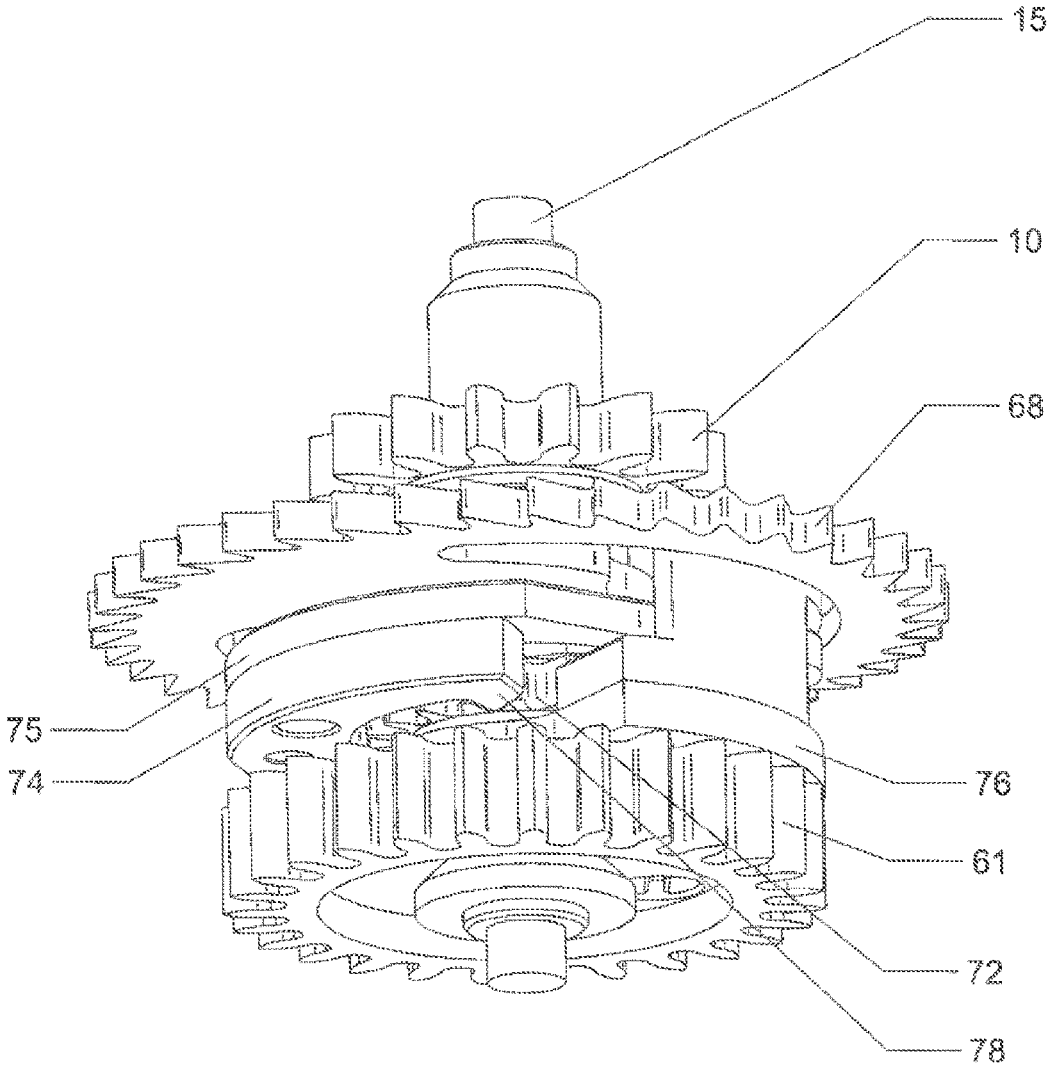
Figure 11:
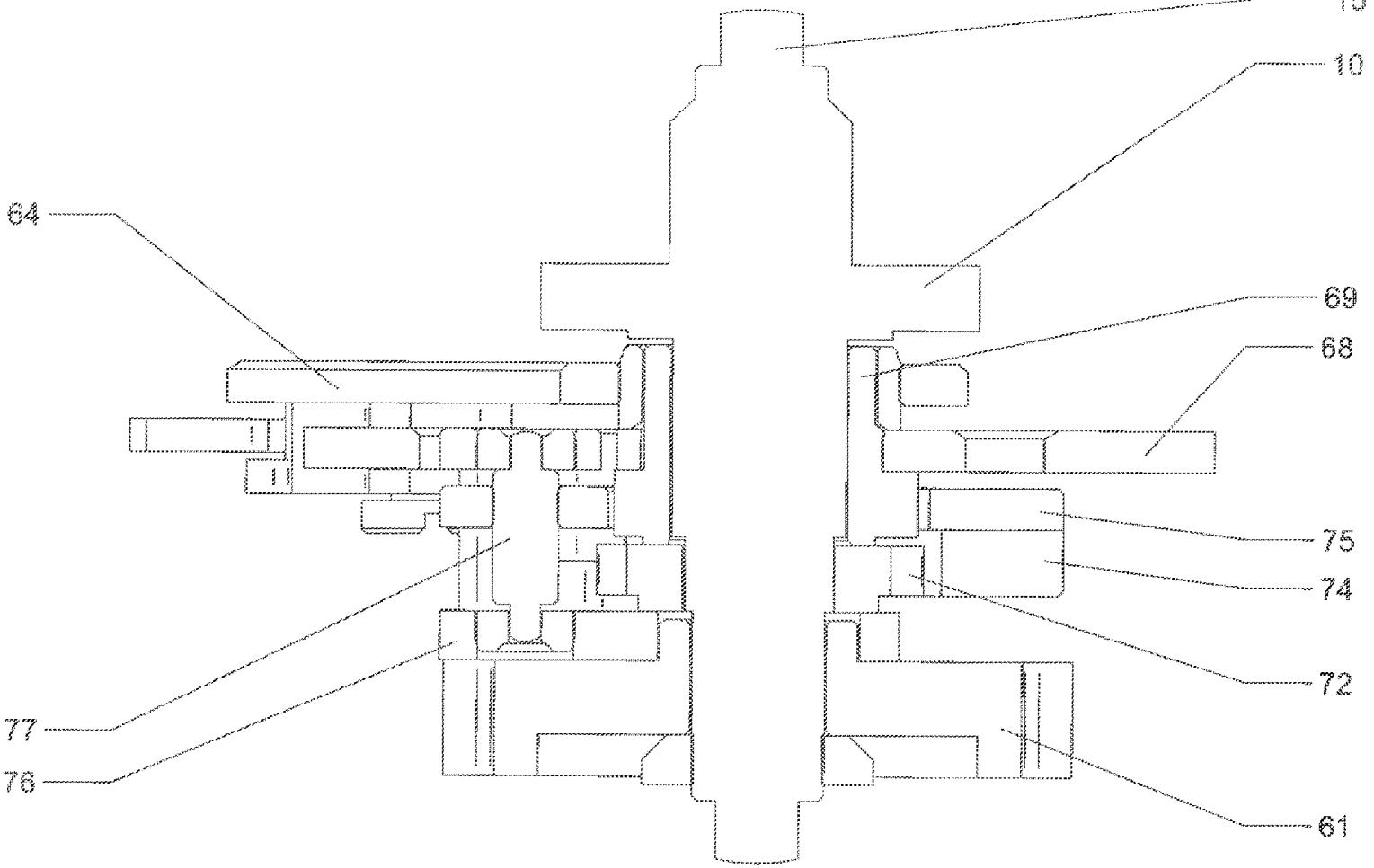
FIG. 11 is a cross-sectional view of FIG. 8.

The operation of the elements described above is as follows. When idle, the elements are in the position shown in FIGS. 3 and 4, the hooks 18 and 30 being engaged with the toothings 21 and 34, respectively, such that the hours, quarters, and minutes components are kinematically connected. These components are positioned such that the pinion 10 of the strike driving wheel meshes with the first teeth of the toothed sector 9 of the hours component 2 (on the right in FIGS. 3 and 4). The strike driving wheel is in the coupled position. In reference to the driving wheel 40 shown in the coupled position in FIG. 5, when the strike control organ is actuated, it drives the detent ratchet 52 counterclockwise such that the second end 45*b* of the click 45 is also moved counterclockwise by means of the pins 50. In moving, the second end 45*b* moves away from the pinion 46 such that the beak 49 is released from said pinion 46. The strike driving wheel 40 is then in the disconnected position, as shown in FIG. 7.

It will be understood that in this disconnected position, the pinions 10 and 46, secured to one another, are no longer kinematically connected to the strike-wheel 41, such that they are free to pivot around the staff 15.

In reference to the driving wheel 60, when the strike control organ is actuated, it drives the rack 64 by its toothing 65 counterclockwise over a predetermined angle. The control click 66 then drives the drive ratchet 68, which in turn drives the central tube 69, which is integral therewith, and its toothed sector 70. All of these parts rotating together, the central tube 69 forms one long single bearing for the assembly, which improves the operating quality. In rotating, the toothed sector 70 of the central tube 69 pushes the toothed sector 82 of the plate 75, thereby causing said plate 75 and the disconnecting click 74 secured therewith to rotate counterclockwise around its pivot 77. Said pivot 77 being offset relative to the staff 15, the movement of the disconnecting click 74 is not concentric to the staff 15. In this way, the beak 78 of the disconnecting click 74 is freed from its disconnecting ratchet 72, to reach the disconnected position. It will be understood that in this disconnected position, the disconnecting ratchet 72 being secured to the staff 15 and the pinion 10, and the disconnecting click 74 being connected to the strike-wheel 61 by the plate 75 and its pivot 77, said pinion 10 is no longer kinematically connected to the strike-wheel 61, such that they are free to pivot around the staff 15.

The hours component 2 is thereby also free to pivot around its staff 3, its toothed sector 9 rotating the released pinion 10. Under the action of its return-spring, the hours component 2 then rotates clockwise until the hour feeler-spindle 12 reaches the hour cam 13 positioned as a function of the current time. The pinion 10 is then positioned in a corresponding manner on the toothed sector 9 (on the left in FIG. 1).

When the hours component 2 is rotated, the hook 18 encounters the banking 22 such that the latter pivots and is released from the toothing 21. The quarters component 4 is thus released. Under the thrust from its spring, the quarters component 4 pivots clockwise and falls on the quarter cam 5 positioned as a function of the current time. Likewise, during rotation of the quarters component 4, the hook 30 encounters the banking 36 such that the latter pivots and is released from the toothing 34. The minutes component 6 is thus released. Under the thrust from its spring, the minutes component 6 pivots clockwise and falls on the minute-cam 27 positioned as a function of the current time. The pieces thus placed, as shown in FIGS. 1 and 2, act to strike, powered by the energy source of the strike-train.

In reference to the strike driving wheel 40, the control organ driving the detent ratchet 52 is returned to the rest position by a spring and blocks the detent ratchet 52. During striking, it will then be used as a jumper for the detent ratchet 52.

The strike-wheel 41 is driven counterclockwise by the other elements of the strike-train such that the plate 44, the staff 47 and the first end 45*a* of the click 45 also advance in the counterclockwise direction. The pin 50 being engaged in the detent ratchet 52, locked in rotation by its control organ, retains the click 45 such that said click 45 tilts around the staff 47 while returning the beak 49 toward the pinion 46 until the beak 49 cooperates with said pinion 46 to reach the coupled position shown in FIG. 5. In that position, the pinions 46 and 10 are kinematically connected to the strike-wheel 41 by means of the click 45, such that the pinion 10 pivots counterclockwise.

In reference to the strike driving wheel 60, the control organ is returned to the rest position by a spring and blocks the toothing 65 of the rack 64. Its control click 66 then retains the drive ratchet 68 through the force of the spring 67. The drive ratchet being retained, the central tube 69 and its toothed sector 70 are also retained. The toothed sector 70 of the central tube 69 then retains the toothed sector 82 of the plate 75.

The strike-wheel 61 is driven by the other elements of the strike-train in the counterclockwise direction. The pivot 77 of the plate 75 being secured to the strike-wheel, it also advances counterclockwise. The combination of the movement of the pivot 77 of the plate 75 and the force of its toothed sector 82 causes a movement of the disconnecting click 74, its beak 78 tilting toward its disconnecting ratchet 72. The beak 78 of the disconnecting click 74 reaches the disconnecting ratchet 72 and then begins to push it to reach the coupled position. In that position, the disconnecting ratchet 72 being secured to the staff 15 and therefore the pinion 10, said pinion 10 is then kinematically connected to the strike-wheel 61 by means of the disconnecting click 74, such that the pinion 10 pivots counterclockwise.

Once coupled, it is the disconnecting click 74 which, via the toothed sector 82 of the plate 75, drives the central tube 69 and therefore the drive ratchet 68 secured therewith. The rack 64 being retained by its control organ, it cannot move in that direction, its control click 66 then being arranged to allow the drive ratchet 68 to pass.

The pinion 10, pivoting counterclockwise, drives a rotational movement of the hours component 2 in the counterclockwise direction. The hour-rack 11 cooperates with the hour lift 7*a* to raise the first hammer as a function of the current time. When the hours have struck, the hours component 2 continues to rotate by driving the hook 18 with it. The hook 18 is arranged such that it leaves the banking 22, pivots and comes into contact with one of the teeth of the drive toothing 21 as a function of the position of the quarters component 4 dependent on the current time.

The driving of the quarters component by the hours component using a hook and a toothing respectively provided on one or the other of said components according to the invention makes it possible to eliminate the dead times. In fact, the hook 18 and the drive toothing 21 are sized and positioned such that the hook 18 directly penetrates the tooth of the drive toothing 21 that corresponds to the number of quarters to be struck.

When the hours have finished striking, the hook 18 is still in the same place irrespective of the number of hours struck. As a result, it falls on the tooth of the quarters component that is positioned across from the hook by means of the quarter feeler-spindle as a function of the number of quarters to be struck.

The quarters component 4 driven by the hours component 2 using the hook 18 pivots counterclockwise, its toothings 16*a*, 16*b* cooperating with the quarter lifts 7*b*, 8*b* to raise the first hammer and the second hammer as a function of the current time.

When the quarters have struck, the quarters component 4 continues to rotate, driving the hook 30 with it. The hook 30 is arranged such that it leaves the banking 36, pivots, and comes into contact with one of the teeth of the drive toothing 34 as a function of the position of the minutes component 6 dependent on the current time.

The minutes component 6 driven by the quarters component 4 using the hook 30 pivots counterclockwise, the minute-rack 25 cooperating with the minute-lift 8*a* to raise the second hammer as a function of the current time.

In addition to eliminating the dead times, the driving of the quarters component by the hours component using a hook and a toothing respectively provided on one or the other of said components according to the invention makes it possible to simplify the strike driving wheel as compared with a traditional strike driving wheel that comprises an hour-ratchet, a quarter-pinion and its driving mechanism, such as a finger cooperating with a pin.

The invention claimed is:

1. A timepiece comprising a striking mechanism comprising a strike-train, at least two strike-hammers arranged to produce sounds of different timbres, an hour lift and a first quarter lift to actuate one of the hammers, a minute lift and a second quarter lift to actuate the other hammer, an hours component comprising a toothed sector arranged to cooperate with the strike-train, an hour-rack arranged to actuate the hour lift and an hour feeler-spindle arranged to cooperate with an hour cam, a quarters component comprising a quarter-rack having a first toothing arranged to actuate the second quarter lift and a second toothing arranged to actuate the second quarter lift, and a quarter feeler-spindle arranged to cooperate with a quarter cam, and a minutes component comprising a minute-rack arranged to actuate the minute lift and a minute feeler-spindle arranged to cooperate with a minute cam, said hour, quarter and minute components being pivotably mounted around a same staff, the quarters component and the minutes component being kinematically connected using a first driving organ cooperating with a first driving toothing, wherein one of the hours component and the quarters component comprises a second driving toothing and the other of the hours component and the quarters component comprises a second driving organ arranged to be able to cooperate with said second driving toothing and kinematically connect the hours component and the quarters component, by eliminating the dead time between the striking of the hours and that of the quarters, or between that of the hours and that of the minutes when there is no quarter to strike, wherein the strike-train comprises a strike driving wheel comprising, arranged coaxially, a strike-wheel cooperating with an energy source, a first pinion cooperating with the hours component, and a coupling system, said coupling system being part of the strike-train and being arranged to move between a coupled position, in which said strike-wheel is kinematically connected to said first pinion to allow striking, and an uncoupled position, in which said first pinion is disconnected from said strike-wheel to allow preparation for striking.

2. The timepiece according to claim 1, wherein the first driving organ comprises a first hook pivotably mounted on the quarters component and wherein the first driving toothing is provided on the minutes component across from said first hook.

3. The timepiece according to claim 2, wherein a first banking is provided mounted stationary on the frame of the timepiece, the first hook being arranged to cooperate with said first banking so as to pivot to cooperate with one of the teeth of said first driving toothing as a function of the position of the minutes component.

4. The timepiece according to claim 3, wherein a second banking is provided mounted stationary on the frame of said timepiece, the second driving organ being arranged to cooperate with said second banking so as to be able to cooperate with one of the teeth of said second driving toothing as a function of the position of said second driving toothing and eliminate the dead times.

5. The timepiece according to claim 1, wherein the second driving organ comprises a second hook.

6. The timepiece according to claim 5, wherein said second hook is pivotably mounted on the hours component and wherein the second driving toothing is provided on the quarters component across from said second hook.

7. The timepiece according to claim 1, wherein the coupling system comprises a click secured to the strike-wheel and having a beak and a second pinion secured to the first pinion and arranged to be able to cooperate with the beak of the click, said click being arranged to move between the coupled position, in which the beak cooperates with said second pinion, said first and second pinions being rotated by the strike-wheel, and the uncoupled position, in which the beak of the click is freed from said second pinion, said first and second pinions then being freely rotating relative to the strike-wheel.

8. The timepiece according to claim 7, wherein the coupling system comprises a first plate secured to the strike-wheel, the click being supported by said first plate, said click comprising a first end pivotably mounted on said first plate and a second free end having the beak.

9. The timepiece according to claim 8, wherein the click bears a pin cooperating with a detent ratchet mounted freely rotating coaxially to the strike-wheel and controlled by a control organ, one part of the click between the pin and the beak being arranged eccentrically relative to the axis of the strike driving wheel.

10. The timepiece according to claim 9, wherein, to reach the uncoupled position, said detent ratchet is arranged to be driven by said control organ, and to move the second end of the click by driving the pin such that the beak of the click is freed from the second pinion.

11. The timepiece according to claim 9, wherein, to reach the coupled position, said detent ratchet is arranged to be blocked by said control organ, so as to retain the pin, and wherein the strike-wheel is arranged to be rotated and to take the first plate and the first end of the click such that said click tips while returning its beak into cooperation with the second pinion.

12. The timepiece according to claim 1, wherein a second pinion is secured to the first pinion, and the coupling system comprises a plate comprising a first toothed sector, with the plate being pivotably mounted on the strike-wheel, and with the click being secured to said plate.

13. The timepiece according to claim 12, wherein the coupling system comprises a central tube having a second toothed sector arranged to cooperate with the first toothed sector of the plate and secured to a control ratchet controlled by a control organ.

14. The timepiece according to claim 13, wherein, to reach the uncoupled position, said control ratchet is arranged to be driven by said control organ, and to move the click by driving the first toothed sector of the plate such that the beak of the click is freed from the second pinion.

15. The timepiece according to claim 13, wherein, to reach the coupled position, said control ratchet is arranged to be blocked by said control organ, so as to retain the first toothed sector of the second plate, and wherein the strike-wheel is arranged to be rotated and to take the second plate and the click such that said click tips while returning its beak into cooperation with the second pinion.

* * * * *